US010458414B2

(12) United States Patent
Malvasi et al.

(10) Patent No.: US 10,458,414 B2
(45) Date of Patent: Oct. 29, 2019

(54) AUTOMOTIVE ELECTRIC LIQUID PUMP

(71) Applicant: PIERBURG PUMP TECHNOLOGY GMBH, Neuss (DE)

(72) Inventors: Alessandro Malvasi, Leghorn (IT); Andreas Wulf, Duesseldorf (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 337 days.

(21) Appl. No.: 15/123,650

(22) PCT Filed: Mar. 6, 2014

(86) PCT No.: PCT/EP2014/054372

§ 371 (c)(1),
(2) Date: Sep. 5, 2016

(87) PCT Pub. No.: WO2015/131948

PCT Pub. Date: Sep. 11, 2015

(65) Prior Publication Data

US 2017/0067469 A1 Mar. 9, 2017

(51) Int. Cl.

| | |
|---|---|
| ***F04D 13/06*** | (2006.01) |
| ***F04D 29/041*** | (2006.01) |
| ***F04D 29/047*** | (2006.01) |
| ***F01M 1/02*** | (2006.01) |
| ***F01P 5/12*** | (2006.01) |
| ***F04D 1/00*** | (2006.01) |
| ***F04D 15/00*** | (2006.01) |

(Continued)

(52) U.S. Cl.

CPC ..... *F04D 13/0633* (2013.01); *F01M 1/02* (2013.01); *F01P 5/12* (2013.01); *F04D 1/00* (2013.01); *F04D 15/00* (2013.01); *F04D 29/043* (2013.01); *F04D 29/046* (2013.01); *F04D 29/0413* (2013.01); *F04D 29/0473* (2013.01); *F04D 29/22* (2013.01); *F01M 2001/0215* (2013.01); *F01M 2001/0238* (2013.01); *F01P 2005/125* (2013.01); *F04D 13/0646* (2013.01)

(58) Field of Classification Search

CPC ..... F04D 13/0633

See application file for complete search history.

(56) References Cited

U.S. PATENT DOCUMENTS 3,960,468 A * 6/1976 Boorse ..... F04D 13/0613 417/423.13

5,356,272 A * 10/1994 Nagata ..... F02M 37/08 417/366

(Continued)

FOREIGN PATENT DOCUMENTS

CN 200982309 Y 11/2007

CN 101171427 A 4/2008

(Continued)

*Primary Examiner* — Patrick Hamo

(74) *Attorney, Agent, or Firm* — Norman B. Thot

(57) ABSTRACT

An automotive electric liquid pump includes a separation can having a radial inside which includes a static bearing ring, a pump rotor, and a motor rotor which rotates in the separation can. The motor rotor includes a radial outside having a cylindrical rotor bearing ring. The static bearing ring of the separation can corresponds to the cylindrical rotor bearing ring of the motor rotor. A first radial slide bearing is defined by the cylindrical rotor bearing ring and the static bearing ring.

14 Claims, 1 Drawing Sheet

(51) Int. Cl.

| | |
|---|---|
| ***F04D 29/043*** | (2006.01) |
| ***F04D 29/046*** | (2006.01) |
| ***F04D 29/22*** | (2006.01) |

(56) References Cited

U.S. PATENT DOCUMENTS

| | | | | |
|---|---|---|---|---|
| 5,644,178 | A * | 7/1997 | Halm | H02K 3/50 310/43 |
| 6,351,048 | B1 | 2/2002 | Schob et al. | |
| 2005/0019182 | A1* | 1/2005 | Klein | F04D 29/026 417/420 |
| 2006/0057006 | A1* | 3/2006 | Williams | F04D 13/0633 417/423.14 |
| 2008/0199334 | A1 | 8/2008 | Sorensen | |
| 2010/0288316 | A1* | 11/2010 | Ertle | A47L 15/4225 134/184 |
| 2014/0003977 | A1 | 1/2014 | Bresolin | |
| 2016/0365768 | A1* | 12/2016 | Popov | F04D 13/0626 |

FOREIGN PATENT DOCUMENTS

| | | | |
|---|---|---|---|
| CN | 103443467 | A | 12/2013 |
| DE | 44 18 166 | A1 | 11/1995 |
| DE | 10 2004 047 635 | A1 | 4/2006 |
| DE | 10 2008 055 613 | A1 | 5/2010 |
| EP | 2 273 123 | A1 | 1/2011 |
| JP | 57-135296 | A | 8/1982 |
| JP | H04-353291 | A | 12/1992 |
| JP | 2001-16887 | A | 1/2001 |
| WO | WO2012/123978 | A2 | 9/2012 |

* cited by examiner

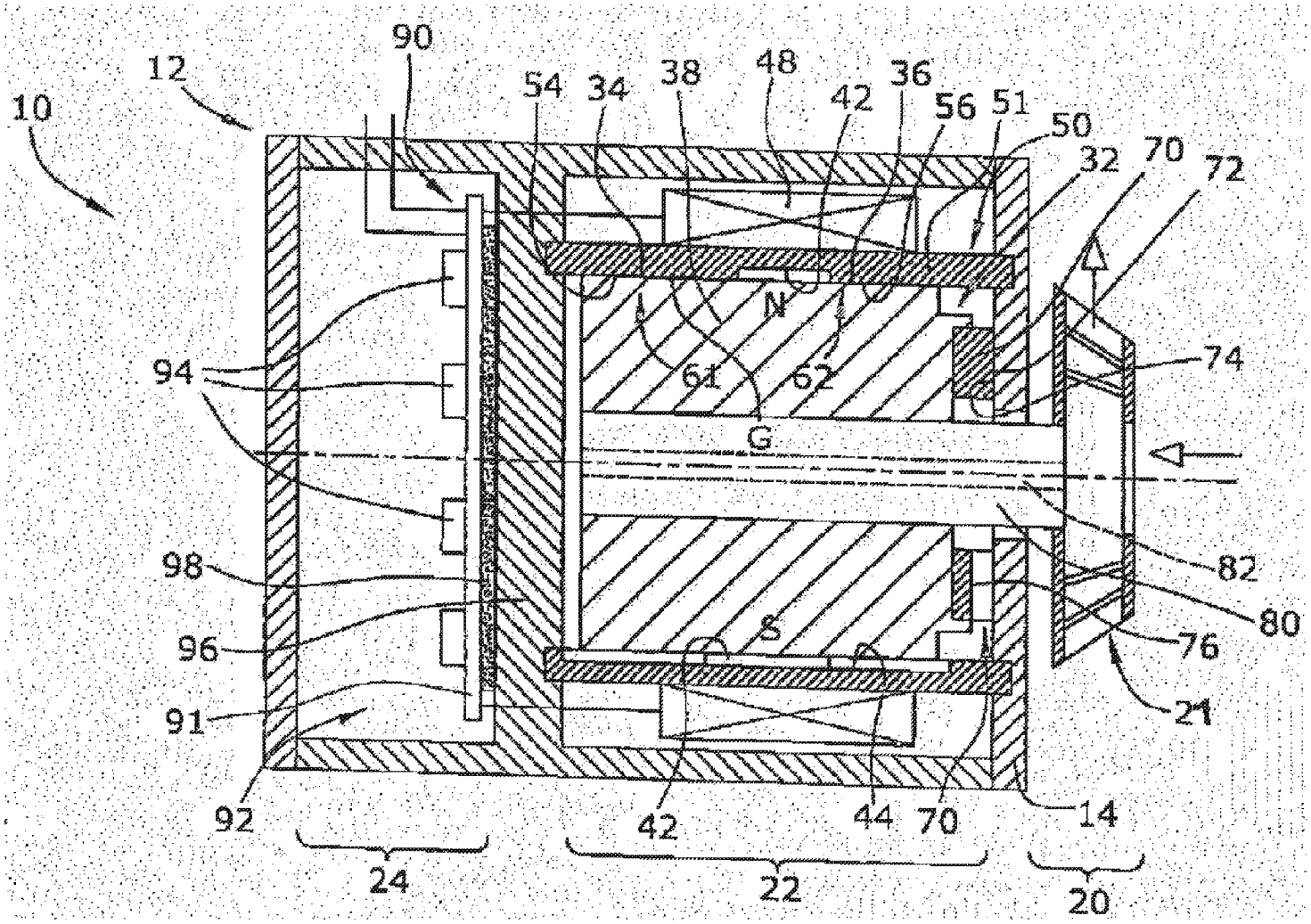
10
12
90
54
34
38
48
42
36
56
51
50
32
70
72
74
80
82
76
21
14
20
70
44
22
42
24
92
91
96
98
94
62
64
G
N
S

AUTOMOTIVE ELECTRIC LIQUID PUMP

CROSS REFERENCE TO PRIOR APPLICATIONS

This application is a U.S. National Phase application under 35 U.S.C. § 371 of International Application No. PCT/EP2014/054372, filed on Mar. 6, 2014. The International Application was published in English on Sep. 11, 2015 as WO 2015/131948 A1 under PCT Article 21(2).

FIELD

The present invention relates to an automotive electric liquid pump, for example, to an electric coolant or lubricant pump.

BACKGROUND

Conventional automotive electric liquid pumps are provided with a rotor shaft which co-rotatably supports a motor rotor and a pump rotor. The pump rotor can be part of a positive displacement pump or of a flow pump. The rotor shaft is rotatably supported with two separate roller or slide bearings which are arranged at one free end of the rotor shaft and between the motor rotor and the pump rotor.

SUMMARY

An aspect of the present invention is to provide a compact automotive electric liquid pump.

In an embodiment, the present invention provides an automotive electric liquid pump which includes a separation can comprising a radial inside which comprises a static bearing ring, a pump rotor, and a motor rotor configured to rotate in the separation can. The motor rotor comprises a radial outside which comprises a cylindrical rotor bearing ring. The static bearing ring of the separation can is configured to correspond to the cylindrical rotor bearing ring of the motor rotor. A first radial slide bearing is defined by the cylindrical rotor bearing ring and the static bearing ring.

BRIEF DESCRIPTION OF THE DRAWINGS

The present invention is described in greater detail below on the basis of embodiments and of the drawing in which:

FIG. 1 shows a longitudinal cross section of an automotive electric liquid pump with two radial slide bearings and one axial slide bearing.

DETAILED DESCRIPTION

The automotive electric liquid pump according to the present invention is provided with a pump rotor and a motor rotor, both co-rotatably supported by a rotor shaft. The electric motor of the pump is provided as a so-called can motor. The motor rotor rotates in a separation can which fluidically separates the wet motor rotor chamber from the dry part of the pump and in particular fluidically separates the motor rotor from the motor stator comprising electromagnetic stator coils. The radial outside of the motor rotor is provided with a cylindrical bearing ring, and the radial inside of the separation can is provided with a corresponding static and cylindrical bearing ring. The cylindrical rotor bearing ring and the cylindrical static bearing ring together define a radial slide bearing. The radial slide bearing is arranged within the axial extension of the motor rotor and is not arranged axially outside of the motor rotor. The total axial length of the pump can therefore be reduced because one or even two bearings axially outside of the motor rotor can be avoided.

The radial slide bearing is provided as a so-called plane bearing but is not provided as a floating support arrangement. The radial bearing gap G between the static bearing ring and the rotor bearing ring is therefore small and allows for a lubrication of the bearing within the bearing gap G with the coolant liquid or with the lubrication liquid. The liquid can be a coolant liquid for cooling an internal combustion engine or other automotive devices, a hydraulic liquid for hydraulic devices in an automotive vehicle, or a lubricant for lubrication of an internal combustion engine or other automotive devices. The liquid in practice is water, fuel or oil.

In an embodiment of the present invention, the radial bearing gap G of the radial slide bearing can, for example, be less than 0.5 mm, for example, is less than 0.25 mm. The radial bearing gap G must be as small as possible to provide relatively small gaps of the pump rotor with respect to the pump housing to thereby provide a high hydraulic efficiency of the pump section of the pump. The radial bearing gap G must be large enough to provide a sufficient lubrication of the bearing gap between the static bearing ring and the rotor bearing ring.

In an embodiment of the present invention, at least two separate radial slide bearings can, for example, be provided at the motor rotor and a corresponding number of static bearing rings can, for example, be provided at the separation can. One separate radial slide bearing can, for example, be provided at both axial ends of the motor rotor, respectively. This arrangement of the two radial slide bearings provides a maximum stability against tilting of the complete rotor arrangement and a minimum friction.

In an embodiment of the present invention, a separate axial slide bearing can, for example, be provided which is defined by an axial bearing ring at one axial end surface of the motor rotor and by a static bearing ring. The static bearing ring can be provided by a corresponding ring section of the pump frame or pump housing. Beside the radial bearings, the axial bearing is also provided as a slide bearing which does not need much installation space.

In an embodiment of the present invention, the rotor shaft supporting the motor rotor and the pump rotor can, for example, be provided with a continuous central cooling bore. The liquid pumped by the pump rotor is pushed through the cooling bore from the pump rotor end of the shaft to the other axial end of the shaft, from where the liquid flows radially outwardly and flows axially back through the bearing gap back to the pump section. The liquid can circulate within the motor section of the pump to realize a continuous axial flow of the liquid through the bearing gap between the rotor bearing ring and the static bearing ring.

In an embodiment of the present invention, the motor control electronics can, for example, be provided in a control electronics chamber which is separated from the motor rotor rotating in the liquid by a single transversal separation wall. The liquid flowing through the shaft bore impinges against the transversal separation wall so that the separation wall is continuously cooled by the liquid radially flowing from the axial center to the outside where the liquid axially flows into the radial bearing gap. The secondary liquid circuit defined by the shaft cooling bore and the radial bearing gap therefore has a dual function, i.e., cooling of the separation wall and lubrication of the bearing gap. The electronics, and in particular the power semiconductors, can, for example, be provided to be in heat-conductive contact with the separation wall, for example, by using a heat-conductive adhesive.

In an embodiment of the present invention, the rotor bearing ring can, for example, be made of metal. The rotor bearing ring can be defined by the motor rotor itself and, for example, can be a polished section of the motor rotor. The static bearing ring can, for example, be made of plastic, for example, of PTFE (polytetrafluoroethylene) or PA (polyamide). The material pairing of metal, for example, steel, at one side and of a suitable plastic material, for example, PTFE, at the other side, provides a slide bearing with high mechanical and abrasive stability and low friction.

In an embodiment of the present invention, a circular ring groove can, for example, be provided at the radial inside of the separation can between the two static bearing rings. The ring groove separates the two static bearings rings from each other. The axial length of the ring groove can, for example, be identical with the axial distance of the corresponding static bearings rings. The ring groove provides a very low fluidic resistance in a section where no narrow gap is needed and thereby reduces the total axial flow resistance in the bearing gap over the entire length of the motor rotor.

In an embodiment of the present invention, a longitudinal flow groove can, for example, be provided at the radial inside of the separation can. The longitudinal flow groove can be orientated precisely axially. Alternatively, the longitudinal flow groove can, for example, have a helical orientation with a substantive axial component. The longitudinal flow groove improves the lubrication of the radial slide bearings because the liquid can also flow into the bearing gap from a circumferential/tangential direction coming from the longitudinal flow groove, not only from an axial direction as it would be the case without a longitudinal flow groove. The longitudinal flow groove also reduces the total axial flow resistance. Two or even more longitudinal flow grooves can, for example, be provided.

A description of an embodiment of the present invention is described below with reference to the drawing.

FIG. 1 shows an electric automotive liquid pump 10 which is configured as a flow pump, for example, as a coolant pump or as a fuel pump. The liquid pump 10 can alternatively also be realized as a positive displacement pump, for example, to pump a lubricant to lubricate an internal combustion engine.

The liquid pump 10 is provided, as seen in an axial direction, with a pump section 20, a motor section 22, and a control section 24. The pump section 20 is provided with a pump rotor 21 which is, in the shown embodiment, an impeller wheel with an axial inlet opening. The pump rotor 21 can alternatively be designed and provided as a part of a positive displacement pump, for example, a gerotor pump, a vane pump, or another rotating displacement pump.

The pump rotor 21 is supported by a co-rotating the rotor shaft 80 which is co-rotatably fixed to the motor rotor 32. The motor rotor 32 is defined by a motor rotor body 38 which is made of a ferromagnetic material which is permanently magnetized. The motor rotor 32 is magnetically driven by a motor stator which is defined by a number of motor stator coils 48 which generate a rotating magnetic field which is followed by the permanently magnetized motor rotor 32. The motor section 22 is designed as a canned motor with a cylindrical separation can 50 separating the wet motor rotor 32 from the dry motor stator coils 48. The separation can 50 is defined by a cylindrical can body 51 made of plastic.

The control section 24 is defined by control electronics 90 arranged within a control electronics chamber 92. The control electronics 90 is defined by a printed circuit board 91 comprising power semiconductors 94 for electrically switching the motor stator coils 48. The control electronics chamber 92 is separated from the motor section 22 by a transversal separation wall 96. The printed circuit board 91 is fixed to and thermally connected to the separation wall 96 by a heat-conductive adhesive 98 or paste which is in particular applied opposite to the power semiconductors 94.

The motor rotor 32 is rotatably supported by two radial slide bearings 61, 62 and by one axial slide bearing 70. A first radial slide bearing 61 is defined by a cylindrical static bearing ring 54 at the radial inside of the plastic separation can 50 and a corresponding cylindrical rotor bearing ring 34 at the radial outside of the motor rotor 32. A second radial slide bearing 62 is defined by a cylindrical static bearing ring 56 at the radial inside of the plastic separation can body 51 and a corresponding rotor bearing ring 36 at the radial outside of the motor rotor 32. The radial bearing gap G between the bearing surfaces of the rotor bearing ring 34 and of the static bearing ring 54 and of the rotor bearing rings 36 and of the static bearing ring 56 of both radial sliding bearings 61, 62 is about 0.1 mm.

The rotor bearing rings 34, 36 are defined by the polished cylindrical surface of the motor rotor body 38 made out of ferromagnetic steel or of another ferromagnetic metal. The static bearings rings 54, 56 are defined by a cylindrical inner surface of the separation can body 51 which is made of plastic, for example, of PTFE. The two radial slide bearings 61, 62 are axially separated by a circumferential ring groove 42 with a radial depth of more than 0.5 mm. The separation can 50 is also provided with two parallel longitudinal flow grooves 44 which axially overlap the two radial slide bearings 61, 62. The radial depth of the longitudinal flow grooves is more than 0.5 mm.

The axial slide bearing 70 is defined by a separate axial bearing ring body which is fixed to the motor rotor body 38. The axial bearing ring body is made of PTFE and is provided with three radial slits 76. The axial bearing ring body defines an axial bearing ring 72 which cooperates with a corresponding static bearing ring 74 defined by a transversal wall 14 between the motor section 22 and the pump section 20.

The transversal wall 14 and the separation wall 96 are part of a pump housing 12 which is made of metal, for example, made of aluminum. The separation can body 51 is held in corresponding circumferential grooves of the separation wall 96 and the transversal wall 14.

The rotor shaft 80 is provided with a continuous central cooling bore 82 which allows the liquid to flow from the pump section 20 to the separation wall 96 where the liquid flows radially to the outside and then axially back through the radial bearing gap G of both radial slide bearings 61, 62 to the pump section 20.

The present invention is not limited to embodiments described herein; reference should be had to the appended claims.

What is claimed is:

1. An automotive electric liquid pump comprising:

a separation can comprising a radial inside which comprises a first static bearing ring;

a pump rotor;

a motor rotor configured to rotate in the separation can, the motor rotor comprising a radial outside which comprises a cylindrical rotor bearing ring, the first static bearing ring of the separation can being configured to correspond to the cylindrical rotor bearing ring of the motor rotor;

a first radial slide bearing defined by the cylindrical rotor bearing ring and the first static bearing ring;

motor coils configured to drive the motor rotor, the motor coils being arranged on a radial outside of the separation can; and a separate rotor shaft configured to support the motor rotor, the separate rotor shaft being at least one of disposed radially inside the motor rotor and disposed along the axial length of the motor rotor, wherein, the first static bearing ring of the separation can and the cylindrical rotor bearing ring of the motor rotor are each arranged to at least partially overlap axially with the motor coils.

2. The automotive electric liquid pump as recited in claim 1, wherein the first radial slide bearing comprises a radial bearing gap which is less than 0.5 mm.

3. The automotive electric liquid pump as recited in claim 2, wherein the radial bearing gap is less than 0.25 mm.

4. The automotive electric liquid pump as recited in claim 1, further comprising a second radial slide bearing arranged at the motor rotor.

5. The automotive electric liquid pump as recited in claim 1, further comprising:

an axial bearing ring configured to define a separate axial slide bearing; and a second static bearing ring, wherein, the axial bearing ring is arranged at a first axial end of the motor rotor and the second static bearing ring.

6. The automotive electric liquid pump as recited in claim 1, wherein the separate rotor shaft is further configured to support the pump rotor, and the separate rotor shaft comprises a continuous central cooling bore.

7. The automotive electric liquid pump as recited in claim 1, wherein, the motor rotor is further configured to rotate in a liquid, and further comprising:

a single transversal separation wall;

a control electronics chamber configured to be fluidically separated from the motor rotor by the single transversal separation wall; and motor control electronics arranged in the control electronics chamber.

8. The automotive electric liquid pump as recited in claim 7, wherein the motor rotor is arranged axially between the pump rotor and the control electronics chamber.

9. The automotive electric liquid pump as recited in claim 7, wherein the liquid is a coolant or a lubricant.

10. The automotive electric liquid pump as recited in claim 1, wherein the cylindrical rotor bearing ring is made of a metal.

11. The automotive electric liquid pump as recited in claim 1, wherein the first static bearing ring is made of a plastic.

12. The automotive electric liquid pump as recited in claim 11, wherein the plastic is PTFE (polytetrafluoroethylene) or PA (polyamide).

13. The automotive electric liquid pump as recited in claim 1, further comprising:

a second static bearing ring; and a ring groove arranged at the radial inside of the separation can and axially between the first stating bearing ring and the second static bearing ring.

14. The automotive electric liquid pump as recited in claim 1, further comprising:

a longitudinal flow groove arranged at the radial inside of the separation can.

* * * * *